US006342033B1

(12) United States Patent
Walker

(10) Patent No.: US 6,342,033 B1
(45) Date of Patent: Jan. 29, 2002

(54) ACCESSORY FOR FREESTANDING ROTATIONAL MOTION AND RELATIVE DISPLACEMENT TRAINING APPARATUS

(76) Inventor: Guy M. Binx Walker, P.O. Box 681, Ocean Springs, MS (US) 39566

( * ) Notice: Subject to any disclaimer, the term of this patent is extended or adjusted under 35 U.S.C. 154(b) by 0 days.

(21) Appl. No.: 09/802,980

(22) Filed: Mar. 12, 2001

(51) Int. Cl.[7] ..... A63B 21/12
(52) U.S. Cl. ..... 482/114; 482/115; 482/118
(58) Field of Search ..... 482/114, 118, 482/907, 91, 112, 123, 115, 133–135, 136–139

(56) References Cited

U.S. PATENT DOCUMENTS 2,921,741 A * 1/1960 Berne ..... 482/114
4,278,249 A * 7/1981 Forrest ..... 482/114
4,318,546 A * 3/1982 Chen
4,632,393 A * 12/1986 Van Noora ..... 482/114
5,256,124 A * 10/1993 Hughes ..... 482/118
5,391,132 A * 2/1995 Green
5,688,212 A * 11/1997 Walker ..... 482/83
5,755,646 A * 5/1998 Chu ..... 482/118

FOREIGN PATENT DOCUMENTS

GB 2262051 * 6/1991

* cited by examiner

*Primary Examiner*—Jerome Donnelly

(57) ABSTRACT

The present invention provides an improvement for a free-standing apparatus for demonstrating correct rotational movements of the body for different sports activities and for training an individual to perform such movements in the correct order and relative relationship. In an apparatus comprising a vertical support having upper and lower rotational resistance assemblies which are vertically adjustable to be positioned at the user's pectoral and hip levels where the assemblies include mechanisms whereby the degree of resistance to rotational movement may be adjusted, the improvement comprises an optional accessory for the upper assembly providing adjustable upper arm supports which permit selective restriction of rotation of a user's shoulders relative to the upper torso.

15 Claims, 2 Drawing Sheets

ACCESSORY FOR FREESTANDING ROTATIONAL MOTION AND RELATIVE DISPLACEMENT TRAINING APPARATUS

FIELD OF THE INVENTION

The present invention provides an improvement for a freestanding apparatus for demonstrating correct rotational movements of the body for different sports activities and for training an individual to perform such movements in the correct order and relative relationship. In an apparatus comprising a vertical support having upper and lower rotational resistance assemblies which are vertically adjustable to be positioned at the user's pectoral and hip levels where the assemblies include mechanisms whereby the degree of resistance to rotational movement may be adjusted, the improvement comprises an optional accessory for the upper assembly providing adjustable upper arm supports which permit selective restriction of rotation of a user's shoulders relative to the upper torso.

BACKGROUND OF THE INVENTION

Many sports activities depend on the relative rotation of the upper, mid and lower torso areas of the body. Sports such as golf, baseball, tennis, boxing, and the like involve rotational motion and relative displacement in correct order and degree in order to obtain the optimum power to a particular stroke as well as accuracy in the delivery.

The first part of developing such order and degree involves demonstrating to a student the correct relationship and displacement of the body portions. Such demonstration is often difficult in that the action happens quickly and the actual movements are not easy to separate for visual study. Once the movements have been demonstrated and understood, the student must then practice and train himself so that the respective muscle groups are exercised to the proper degree and so that the correct rotational sequence becomes an automatic reflex action.

Such demonstration, training and exercise are best achieved by placing the student in a situation which best approximates the conditions most conducive to correct motion. To that end, the Applicant herein devised an apparatus which selectively restricts and permits rotation of the upper body and hips in a particular sequence for the particular sport. This apparatus is described in Applicant's U.S. Pat. No. 5,688,212, the disclosure of which is incorporated herein by reference.

Through further research, it has been determined that, in addition to the separate and selective rotation of a person's hips and torso, there is often a third separate rotational component through the shoulders that takes place and which requires control for accurate training and exercise. This rotation is described as the reversal of the shoulder position from a first location to a second location and follows rotation of the hips and torso. In order that this third rotational component can be demonstrated and practiced, Applicant has devised an accessory for the apparatus of his prior patent which provides selective restriction of rotation of the shoulders through the upper arms of the user.

SUMMARY OF THE INVENTION

It is an object of the present invention to provide an improvement to the Rota-Flex freestanding rotational motion and relative displacement training apparatus of the Applicant's prior patent.

It is a further object to provide an accessory attachable to the freestanding rotational motion and relative displacement training apparatus which provides selective restriction of rotation of the shoulders through the upper arms of the user.

It is a still further object to provide an accessory which is adjustable to accommodate users of differing sizes and physiques.

It is an even further object to provide an accessory which creates greater tension in a user's upper body and arms and serves to retard the shoulders during rotational training.

Further objects and advantages will become evident from the following drawings and description.

In a freestanding rotational motion and relative displacement training apparatus comprising a base assembly, a vertical support post extending upward from said base assembly, a first resistance assembly adjustably located on said post at a level corresponding to a user's hips and a second resistance assembly adjustably located on said post at a level corresponding substantially to a user's upper torso; the present invention provides an improvement comprising upper arm supports attached to and forwardly extendable from said second resistance assembly, said upper arm supports each comprising a telescopically extensible rod having a member thereon for receiving a user's elbow whereby said user's upper arm and shoulder are held in combination with the upper torso by said upper arm supports and said second resistance assembly.

In a freestanding rotational motion and relative displacement training apparatus comprising a base assembly, a vertical support post extending upward from said base assembly, a first resistance assembly adjustably located on said post at a level corresponding to a user's hips and a second resistance assembly adjustably located on said post at a level corresponding substantially to a user's upper torso; the present invention provides an improvement comprising left and right upper arm supports removably attached to and forwardly extendable from said second resistance assembly, each of said upper arm supports comprising an attachment means, a cylinder having a rod telescopically adjustable therein, elbow receiving means fixed to an exposed end of said rod, and horizontal and vertical angle adjustment means located between said cylinder and said attachment means.

With the accessory of the present invention, the Rota-Flex apparatus provides a new dimension in total body strengthening and figure improvement technique concurrently with proper training in the relative rotational motion of the body for various sports. The resistance assemblies and accessory provide both a pushing and a pulling resistance in the direction of rotation resulting in twelve actions for each cycle of rotation repetition. In rotation of the hips to the left there is a push on the left side and a pull on the right side. When the direction of rotation is reversed, the push and pull are likewise reversed. Similarly, rotation of the upper body results in a cycle of left and right pull and push actions. Finally, the accessory of the present invention adds similar pull and push resistances to the upper arms and shoulders during shoulder reversals. These three levels of exercise, hips, upper body and shoulders, provide a triple trimming effect reducing excesses at the hips and thighs, waist and back and the upper arms and shoulders.

DETAILED DESCRIPTION OF THE INVENTION

Figure 1:
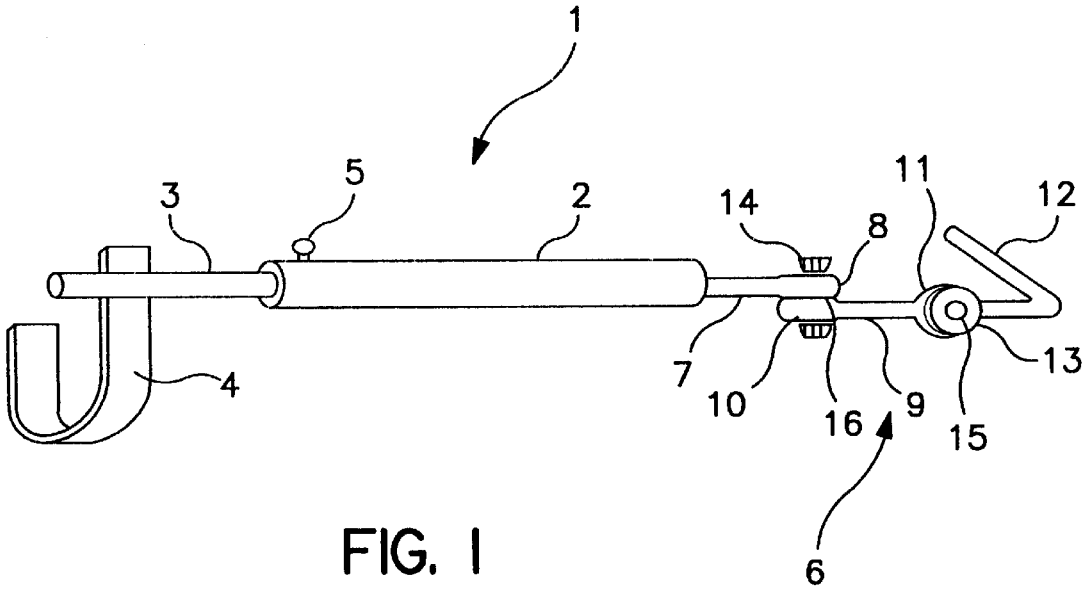
FIG. 1 is a view of the accessory of the present invention.

As shown in FIG. 1, the accessory 1 of the present invention comprises a cylinder 2 from which a rod 3 is telescopically extensible. Securely attached on the free end of the rod 3 is a cuff 4 which is adapted to receive the user's arm at or about the elbow thereof. Preferably, cuff 4 is a rigid U-shaped piece which may be welded to rod 3 as shown and is padded for the comfort and protection of the user. The rod 2 is adjustable relative to the cylinder 3 so as to provide for different arm lengths. A locking means, such as a set screw 5 passing through the cylinder 2 to engage the rod 3 as shown, is provided to releasably fix the rod 3 in the desired extended or retracted position. Alternative locking means may be used, such as an external clamp, a twist lock cam mechanism, or a tightenable collar.

Fixed to the opposite end of the cylinder 2 is a linkage assembly 6 which provides means for attachment of the accessory 1 to the freestanding rotational motion and relative displacement training apparatus as well as adjustment of the vertical and horizontal attitude of the accessory 1 and the resistance to vertical displacement and horizontal rotational displacement of the user's upper arms. The linkage assembly 6 comprises a first rod 7 which is fixed to and extends axially from the end of the cylinder 2. This first rod ends in an eye 8. A second rod 9 comprises a short straight portion having an eye 10 and 11 at each end. Although in the same axial relationship relative to second rod 9, eyes 10 and 11 are oriented in different planes which are perpendicular to each other. Thus, when eye 10 is horizontal, eye 11 is vertical. A third rod 12 competes the linkage assembly 6 and is formed in an L-shape with an eye 13 at one end of the L. Eye 13 is oriented so as to be perpendicular to the plane of the L formed by third rod 12.

Linkage assembly 6 is assembled by means of bolt 14 which passes through eye 8 and eye 10 to form a horizontal pivot joint and by bolt 15 which passes through eye 11 and eye 13 to form a vertical pivot joint. In this manner, first rod 7 and second rod 9 are horizontally pivotable with respect to each other and, by tightening or loosening the bolt 14, the horizontal attitude of the accessory 1 and resistance to horizontal pivoting through this portion of the linkage 6 can be adjusted. Second rod 9 and third rod 12 are vertically pivotable with respect to each other and, by tightening or loosening bolt 15, the vertical attitude of the accessory 1 and resistance to vertical pivoting through this portion of the linkage 6 can be adjusted.

Figure 4:
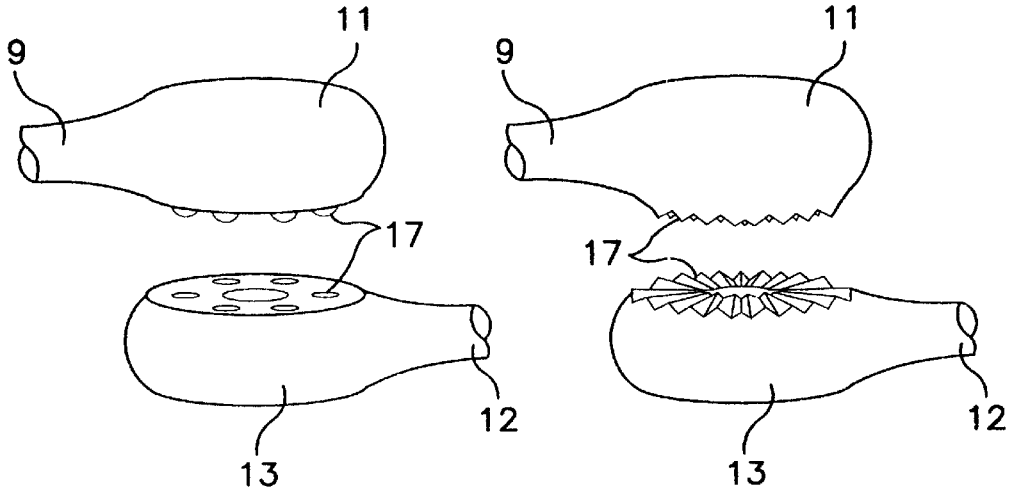
FIG. 4 is a view of a portion of the adjustable linkage of the accessory showing alternative detent means.

It is noted that the primary purpose of the present invention is to provide variable resistance to rotation through the shoulders of a user of the Rota-Flex apparatus which rotation substantially comprises a horizontal component. With that in mind, it is preferred that a friction disk 16 be provided between the adjoining surfaces of the eyes 8 and 10. Friction disk 16 is made from a material which will permit relative movement of the adjoining elements but, upon tightening of bolt 14, will provide increased friction and, thereby resistance to relative movement. Any material which provides a variable coefficient of friction depending on the level of compression to which it is subjected may be used. One such material is carbon impregnated polytetrafluoroethylene where the level of carbon impregnation is from 20 to 50%. Other materials include non-woven fiber materials, fiber impregnated materials, and the like. Similarly, a corresponding friction disk 16 may be provided between eyes 11 and 13. Alternatively, where it is desired that the vertical adjustment of the accessory 1 be fixed, the inner cooperating faces of eyes 11 and 13 my be provided with cooperating detents 17, such as meshing teeth or bumps and recesses, whereby the vertical angle of the accessory 1 can be adjusted and then fixed by releasing bolt 15 to permit release of the detent means then tightening bolt 15 to engage the detent means. Such detent means are shown in FIG. 4.

Figure 2:
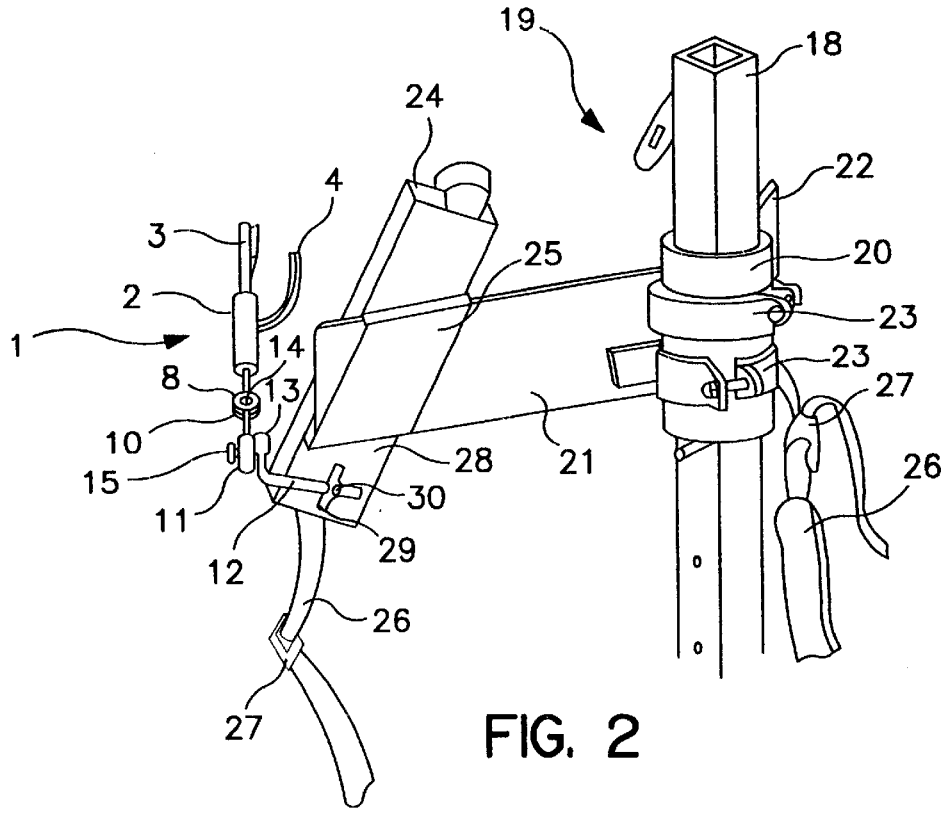
FIG. 2 is a view from the rear of the upper portion of the rotational motion and relative displacement training apparatus showing attachment of the accessory of the present invention thereto.
Figure 3:
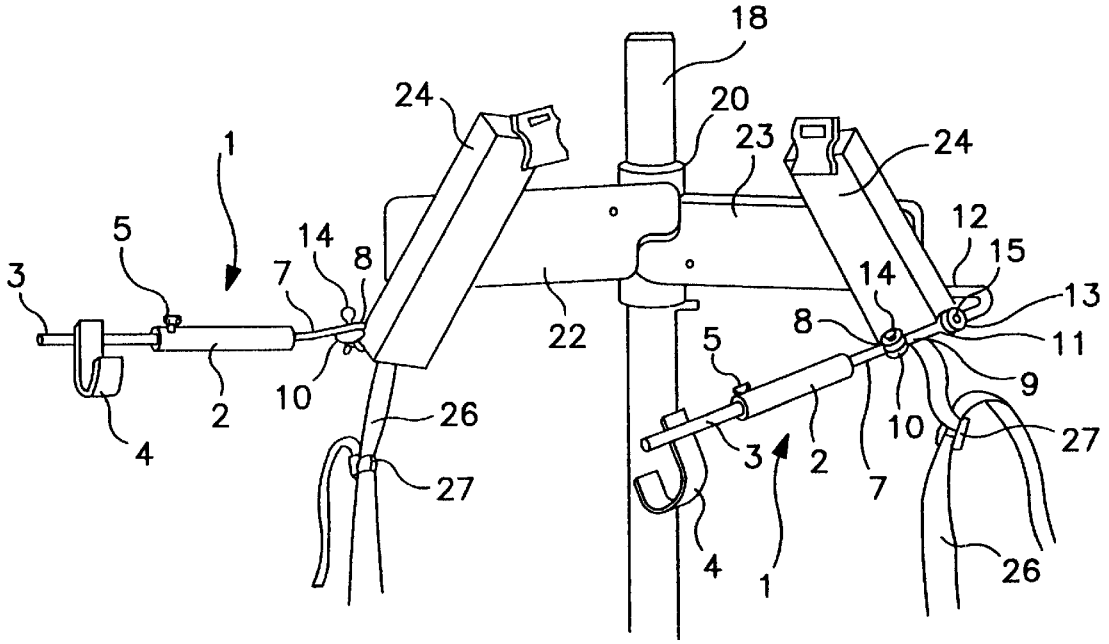
FIG. 3 is a front view of the upper portion of the rotational motion and relative displacement training apparatus showing the relationship of the accessory thereto.

Attachment of the accessory 1 to the Rota-Flex freestanding rotational motion and relative displacement apparatus and the operational relationship of the accessory and the apparatus are shown in FIGS. 2 and 3. The Rota-Flex apparatus comprises a vertical support 18 having upper and lower rotational resistance assemblies which are vertically adjustable to be positioned at the user's pectoral and hip levels. Since the accessory of the present invention attaches to and works with the upper rotational resistance assembly 19 only that assembly is shown and described herein. The upper rotational resistance assembly 19 comprises a collar 20 having a cylindrical outer surface which is slidable along the post 18, but which is prevented from rotating about the post 18, and a pair of rotation arms 21 and 22. The collar 20 provides a vertically adjustable cylindrical body about which the rotation arms 21 and 22 may rotate. The arms 21 and 22 extend substantially perpendicularly relative to the support post 18 and are each mounted on the collar 20 by means of resistance clamps 23 which are used to control the relative resistance to rotation of the arms 21 and 22. Pectoral pads 24 are provided with a back 28 having a bracket 25 which slidably engages the arms 21 and 22 with a fit such they will not be inadvertently moved out of place during use but may be readily adjustable for different users. Belts 26 and buckles 27 are provided to secure the rotational resistance assembly 19 to the user.

To receive the accessory 1, the back 28 of each pectoral pad 24 is provided with at least one receiver 29 which is secured to the back 28 below the bracket 25. Since the pectoral pads are angled inwardly by about 30° to about 60° from vertical, the receiver 29 should be angled in an equal but reverse direction so that, when the accessory 1 is mounted to the apparatus, third rod 12 will be substantially parallel to the ground.

Receiver 29 may comprise a simple clamp means comprising a central U-shaped portion with perpendicular arms by which the receiver is welded to the back 28 such that the U-shaped portion forms a channel dimensioned slightly larger than the diameter of third rod 12. Alternatively, a piece of rigid tubing having an inner dimension to receive third rod 12 may be welded to back 28, a set screw 30 being provided to secure third rod 12 and, thereby, the accessory 1, in place. The length of third rod 12 and the manner in which receiver 29 holds third rod 12 permits the accessory 1 to be adjusted laterally relative to the Rota-Flex apparatus.

In use, the user adjusts the Rota-Flex apparatus as described in U.S. Pat. No. 5,688,212. The lateral position of the accessories is adjusted by loosening set screw 30 and moving the accessories in or out relative to the Rota-Flex apparatus. With the user in place, the position of cuffs 4 are adjusted by moving rod 3 in or out relative to cylinder 2 and then tightening the set screws 5. Preferably, this adjustment should be made so that with the user's arms in the required position for the activity being demonstrated, the cuffs 4 receive the user's elbows. Vertical adjustment of the accessories is made through the joint formed by eyes 11 and 13 while any angular adjustment in the horizontal plane is made through the joint formed by eyes 8 and 10. At this time, the degree of horizontal resistance is also adjusted by tightening or loosening bolt 14. Since the left and right accessory are separate and independent, it is possible to separately control the degree of rotation resistance through each shoulder and upper arm. Taken together with the separate adjustability of the upper and lower resistance assemblies of the Rota-Flex apparatus as well as the separate adjustability of the left and right rotation arms of both the upper and lower resistance assemblies, it is possible to demonstrate the correct sequence of body rotation for a particular activity from the hips up through the upper torso and shoulders on down through the upper arms.

The utility of the accessory is particularly evident in the case of ripple exercises used to demonstrate and develop the sequence of hip rotation, body rotation and shoulder reversal which is the fundamental sequence for sports actions which involve throwing or driving a ball, such as tennis, baseball, golf, or the like. In such sports, the sequence in which the parts of the body rotate during wind-up and action is important for power and accuracy. It is not uncommon for someone to get the gross sequence correct but then to have the action spoiled by the last minute shoulder and/or upper arm reversal coming to soon or too late. By adjusting the horizontal resistance through the accessory 1 relative to the resistance provided to the upper torso by the upper resistance assembly of the Rota-Flex this last minute reversal can be enhanced or delayed as desired. Indeed, where the user's problem is traced to one or the other shoulder/arm beginning its reversal before or after the other shoulder/arm, the appropriate accessory can even be adjusted to compensate thereby training the user to the problem.

The above embodiments and drawings illustrate the preferred embodiments of the present invention and it is understood that many variations and modifications of those embodiments will be evident to those skilled in the art and may be carried out without departing from the spirit and scope of the present invention.

What is claimed is:

1. In a freestanding rotational motion and relative displacement training apparatus comprising a base assembly, a vertical support post extending upward from said base assembly, a first resistance assembly adjustably located on said post at a level corresponding to a user's hips and a second resistance assembly adjustably located on said post at a level corresponding substantially to a user's upper torso; the improvement comprising upper arm supports attached to and forwardly extendable from said second resistance assembly, said upper arm supports each comprising a telescopically extensible rod having a member thereon for receiving a user's elbow whereby said user's upper arm and shoulder are held in combination with the upper torso by said upper arm supports and said second resistance assembly.

2. The apparatus of claim 1 wherein said upper arm supports further comprise a first vertical adjustment means and a second horizontal adjustment means.

3. The apparatus of claim 2 wherein said first and second adjustment means are independent.

4. The apparatus of claim 3 wherein at least said second horizontal adjustment means comprises an adjustable friction connection whereby resistance to horizontal rotational displacement of said upper arm and shoulders is variable.

5. The apparatus of claim 4 wherein said member receiving said elbow comprises a substantially rigid, U-shaped cuff secured to a forward end of said extendable rod.

6. The apparatus of claim 5 wherein said upper arm supports are removably attached to a rear surface of said second resistance assembly and extend forwardly from right and left sides thereof.

7. The apparatus of claim 6 further comprising padding means within said U-shaped cuff.

8. In a freestanding rotational motion and relative displacement training apparatus comprising a base assembly, a vertical support post extending upward from said base assembly, a first resistance assembly adjustably located on said post at a level corresponding to a user's hips and a second resistance assembly adjustably located on said post at a level corresponding substantially to a user's upper torso; the improvement comprising left and right upper arm supports removably attached to and forwardly extendable from said second resistance assembly, each of said upper arm supports comprising an attachment means, a cylinder having a rod telescopically adjustable therein, elbow receiving means fixed to an exposed end of said rod, and horizontal and vertical angle adjustment means located between said cylinder and said attachment means.

9. The apparatus of claim 8 further comprising releasable clamping means on said cylinder whereby said telescopically adjustable rod is clampable in a fixed position relative to said cylinder.

10. The apparatus of claim 9 wherein said horizontal and vertical angle adjustment means comprise adjustable friction connections whereby resistance to horizontal rotational displacement of a user's upper arms and shoulders is variable and whereby resistance to vertical displacement of a user's upper arms is variable.

11. The apparatus of claim 10 wherein said horizontal and vertical angle adjustment means are separately and independently adjustable.

12. The apparatus of claim 9 wherein said horizontal and vertical angle adjustment means are separately and independently adjustable.

13. The apparatus of claim 12 wherein said vertical angle adjustment means comprises a series of cooperating detent means whereby said upper arm supports are angularly adjustable in a vertical direction relative to said base and are fixable in one of several positions.

14. The apparatus of claim 13 wherein said horizontal angle adjustment means comprises an adjustable friction connection means whereby resistance to horizontal rotational displacement of a user's upper arms and shoulders is variable.

15. The apparatus of claim 14 wherein said adjustable friction connection means comprises a disk of material having a variable coefficient of friction disposed within said horizontal angle adjustment means and subject to compression by said horizontal angle adjustment means whereby said coefficient of friction is increased or decreased thereby increasing or decreasing resistance to horizontal rotational displacement.

* * * * *